US010636369B2

(12) United States Patent
Ishizaki

(10) Patent No.: US 10,636,369 B2
(45) Date of Patent: Apr. 28, 2020

(54) DISPLAY DEVICE

(71) Applicant: Japan Display Inc., Minato-ku (JP)

(72) Inventor: Koji Ishizaki, Tokyo (JP)

(73) Assignee: Japan Display Inc., Minato-ku (JP)

( * ) Notice: Subject to any disclaimer, the term of this patent is extended or adjusted under 35 U.S.C. 154(b) by 18 days.

(21) Appl. No.: 16/174,957

(22) Filed: Oct. 30, 2018

(65) Prior Publication Data

US 2019/0130849 A1 May 2, 2019

(30) Foreign Application Priority Data

Oct. 31, 2017 (JP) ..... 2017-210926

(51) Int. Cl.
*G09G 3/34* (2006.01)
*G09G 3/20* (2006.01)

(52) U.S. Cl.
CPC ..... *G09G 3/344* (2013.01); *G09G 3/2007* (2013.01); *G09G 2300/08* (2013.01); *G09G 2320/066* (2013.01); *G09G 2320/0666* (2013.01); *G09G 2360/14* (2013.01)

(58) Field of Classification Search
None
See application file for complete search history.

(56) References Cited

U.S. PATENT DOCUMENTS

2011/0090158 A1* 4/2011 Omori ..... G06F 3/0412 345/173
2011/0175874 A1* 7/2011 Wakimoto ..... G09G 3/3406 345/207
2019/0107765 A1* 4/2019 Whitehead ..... G02F 1/1677

FOREIGN PATENT DOCUMENTS

JP 2011-86117 4/2011

* cited by examiner

*Primary Examiner* — Duane N Taylor, Jr.
(74) *Attorney, Agent, or Firm* — Oblon, McClelland, Maier & Neustadt, L.L.P.

(57) ABSTRACT

According to one embodiment, a display device, includes a display panel including a display portion, and a controller which controls the display panel, wherein the display portion includes pixel including a display element and a photodetector, the controller controls the display element based on a photodetection signal from the photodetector, the display element forms a first reflective region when overlapping a dark portion of the projected image, and forms a second reflective region when overlapping a bright portion of the projected image, a reflectance of the first reflective region is smaller than a reflectance of the second reflective region.

15 Claims, 13 Drawing Sheets

DISPLAY DEVICE

CROSS-REFERENCE TO RELATED APPLICATIONS

This application is based upon and claims the benefit of priority from Japanese Patent Application No. 2017-210926, filed Oct. 31, 2017, the entire contents of which are incorporated herein by reference.

FIELD

Embodiments described herein relate generally to a display device.

BACKGROUND

In recent years, sensors capable of detecting contact or approach of an object such as a finger have been put into practical use as display device interfaces or the like. The capacitive type, the resistive film type, the optical type and the like are known as the sensor types. For example, information input devices comprising photoreceptors and capable of detecting object positions and the like by appropriately correcting photoreceptive signals obtained from the photoreceptors have been disclosed.

DETAILED DESCRIPTION

Figure 1:
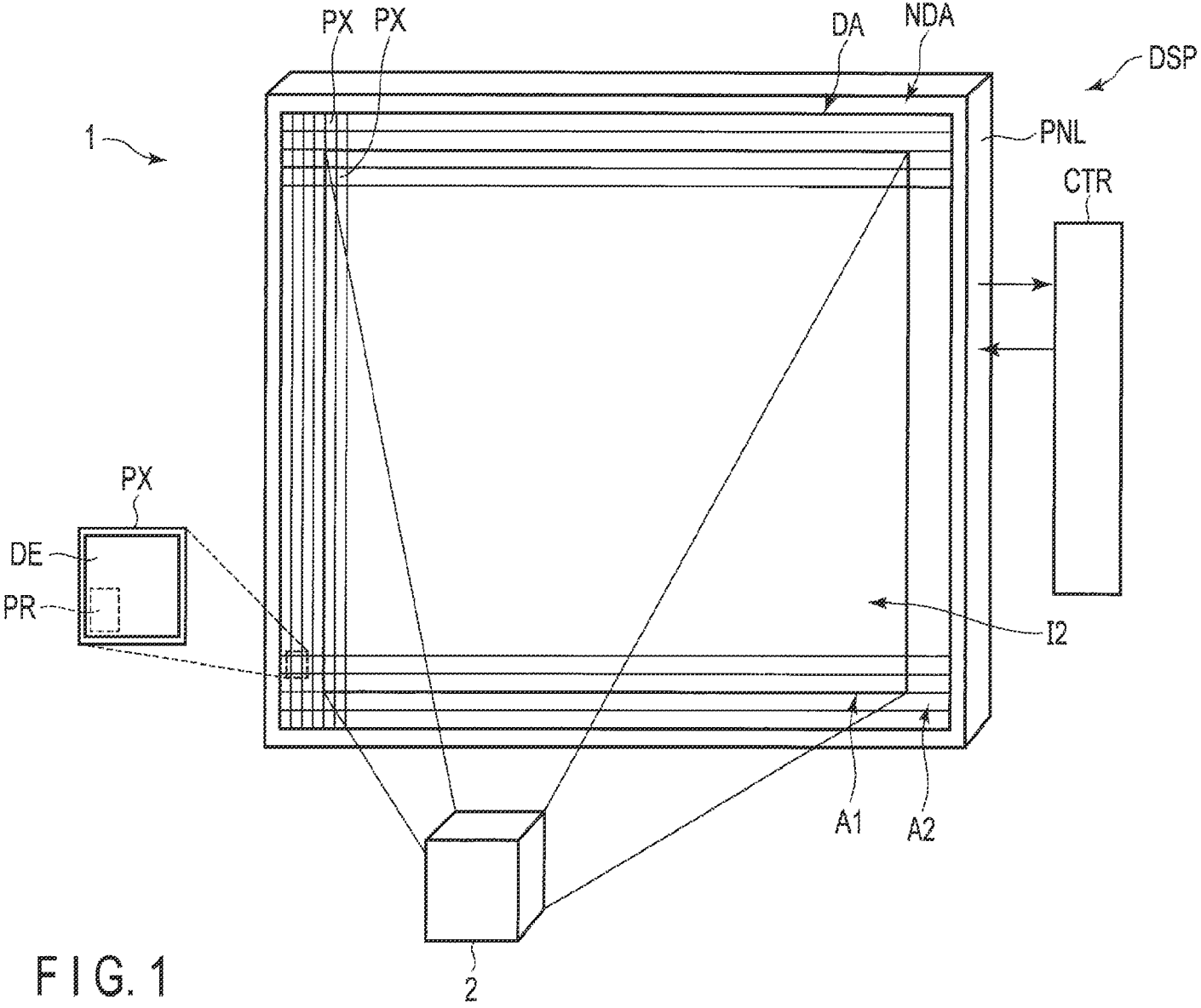
FIG. 1 is an illustration for explanation of a projection system 1 employing a display device DSP of the embodiments.

In general, according to one embodiment, a display device, including: a display panel including a display portion onto which a projected image is projected; and a controller which controls the display panel based on the projected image, wherein the display portion includes a plurality of pixels arranged in matrix, each of the pixels includes a display element and a photodetector, the controller controls the display element based on a photodetection signal from the photodetector, the display element forms a first reflective region when overlapping a dark portion of the projected image, and forms a second reflective region when overlapping a bright portion of the projected image, a reflectance of the first reflective region is smaller than a reflectance of the second reflective region.

Embodiments will be described hereinafter with reference to the accompanying drawings. The disclosure is merely an example, and proper changes in keeping with the spirit of the invention, which are easily conceivable by a person of ordinary skill in the art, come within the scope of the invention as a matter of course. In addition, in some cases, in order to make the description clearer, the widths, thicknesses, shapes and the like, of the respective parts are illustrated schematically in the drawings, rather than as an accurate representation of what is implemented. However, such schematic illustration is merely exemplary, and in no way restricts the interpretation of the invention. In addition, in the specification and drawings, structural elements which function in the same or a similar manner to those described in connection with preceding drawings are denoted by like reference numbers, detailed description thereof being omitted unless necessary.

FIG. 1 is an illustration for explanation of a projection system 1 employing a display device DSP of the embodiments. The projection system 1 comprises a projector 2 and the display device DSP. The display device DSP comprises a display panel PNL and a controller CTR. The display panel PNL includes a display portion DA which faces the projector 2, and a non-display portion NDA around the display portion DA. The non-display portion NDA is formed in a frame shape. The display portion DA includes pixels PX arrayed in a matrix. Each of the pixels PX comprises a display element DE and a photodetector PR as shown in an enlarged view of FIG. 1.

The controller CTR controls the display panel PNL, based on a projected image I2 projected from the projector 2 onto the display portion DA, and controls the display element DE, based on a photodetection signal from the photodetector PR, in each pixel PX.

In the example illustrated, an area of the projected image I2 is smaller than an area of the display portion DA. In such a projecting state, the display portion DA includes a first region A1 to which the projected image I2 is projected and a second region A2 located on a periphery of the first region A1. Each of the first region A1 and the second region A2 includes the pixels PX as explained above, and each of the pixels comprises the display element DE and the photodetector PR.

The area of the projected image I2 may be equal to the area of the display portion DA or may be larger than the area of the display portion DA. In both cases, the display portion DA is the first region A1 alone, and does not include the second region A2.

Figure 2:
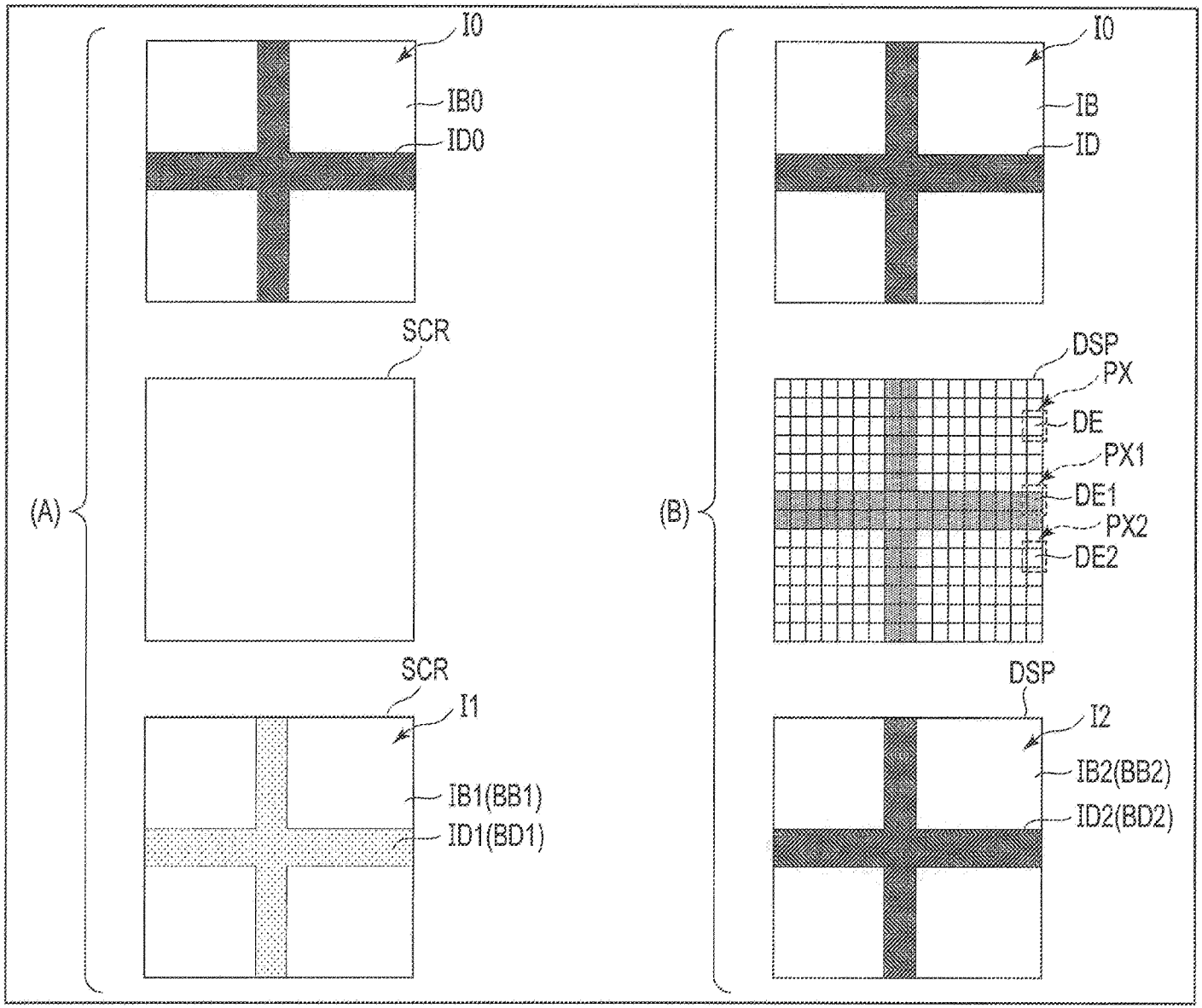
FIG. 2 is an illustration for explanation of an effect obtained by employing the display device DSP of the embodiments.

FIG. 2 is an illustration for explanation of an effect obtained by employing the display device DSP of the embodiments. FIG. 2(A) is an illustration for explanation of a state in which an original image I0 is projected onto a white screen SCR as a comparative example. The original image I0 includes a bright portion IB0 and a dark portion ID0. For example, the dark portion ID0 corresponds to a black image included in the original image I0 while the bright portion IB0 corresponds to a white image, a gray image, or a color image included in the original image I0. The color image corresponds to a red image, a green image, a blue image, and the other color image formed by mixing these color images. The screen SCR has a uniform reflectance over the substantially entire screen. On a projected image I1 formed by projecting the original image I0 onto the screen SCR, when luminance of a bright portion IB1 is BB1 and luminance of a dark portion ID1 is BD1, a contrast ratio is assumed to be represented as BB1:BD1.

FIG. 2(B) corresponds to the embodiments, and is an illustration for explanation of a state in which the original image I0 is projected onto the display device DSP of the embodiments. In the display device DSP, the reflectance is controlled for each of the pixels PX, based on the projected image I2. That is, the display element DE of each pixel PX forms a first reflective region (low reflectance region) when overlapping a dark portion ID2 of the projected image I2. In addition, each display element DE forms a second reflective region (high reflectance region) when overlapping a bright portion IB2 of the projected image I2. The reflectance of the first reflective region is smaller than the reflectance of the second reflective region. In FIG. 2(B), for example, a display element DE1 of a pixel PX1 corresponds to the first reflective region while a display element DE2 of a pixel PX2 corresponds to the second reflective region. The display element DE1 displays black while the display element DE2 displays white.

On the projected image I2 formed by projecting the original image TI0 onto the display device DSP, when luminance of a bright portion IB2 is BB2 and luminance of a dark portion ID2 is BD2, a contrast ratio is assumed to be represented as BB2:BD2. In the embodiments, since the dark portion ID2 overlaps the low reflectance region, the low luminance BD2 can be obtained as compared with a case where the dark portion ID2 overlaps the high reflectance region. In addition, since the bright portion IB2 overlaps the high reflectance region, high luminance BB2 can be obtained as compared with a case where the bright portion IB2 overlaps the low reflectance region. In other words, according to the embodiments, since the dark portion ID2 overlaps the low reflectance region and the bright portion IB2 overlaps the high reflectance region, a difference between the luminance BB2 and the luminance BD2 can be made great and a high contrast ratio can be obtained as compared with a case where each of the bright portion IB2 and the dark portion ID2 overlaps the region having the equivalent reflectance.

Figure 3:
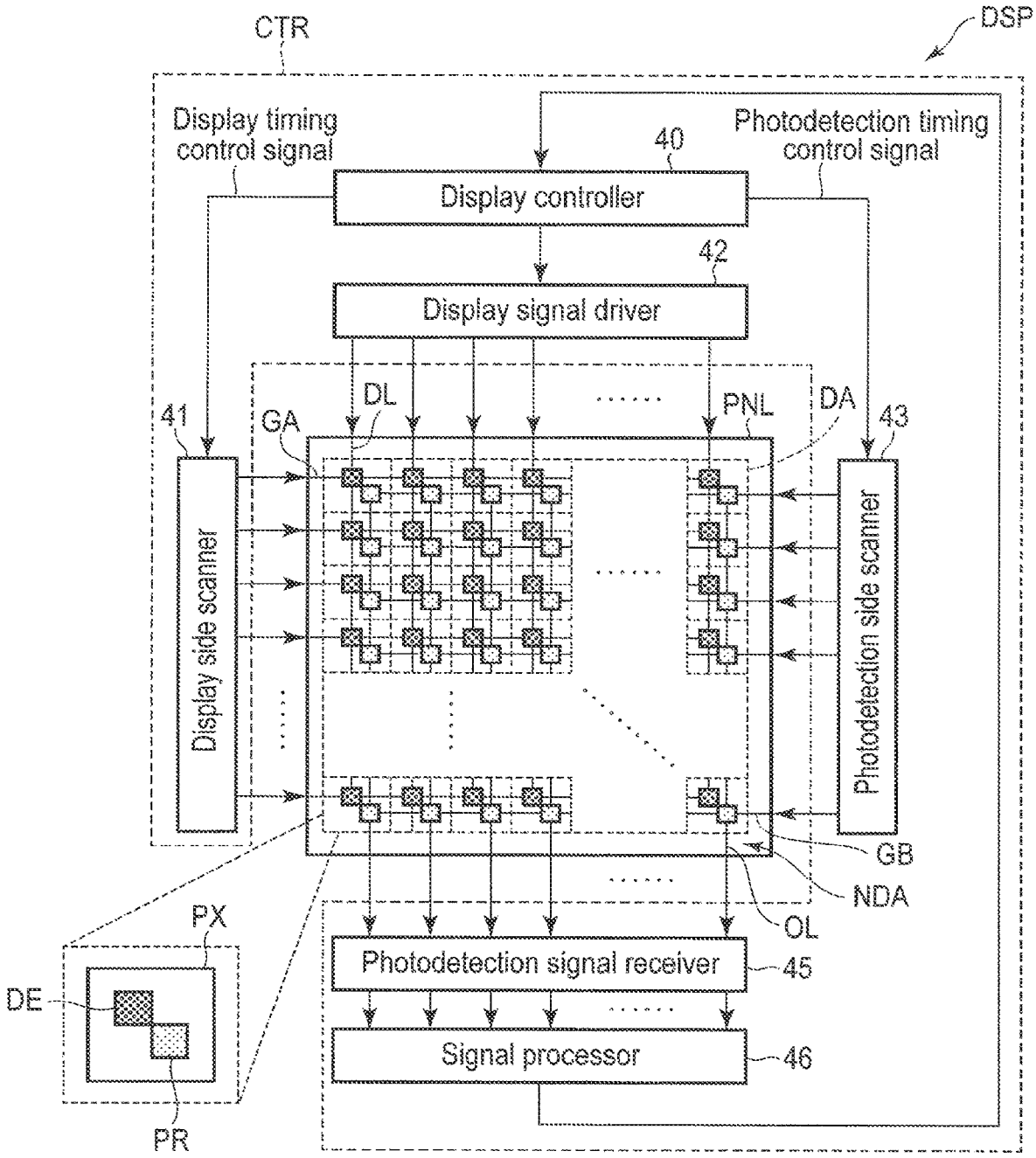
FIG. 3 is a block diagram showing a configuration of the display device DSP of the embodiments.

FIG. 3 is a block diagram showing a configuration of the display device DSP of the embodiments.

On the display panel PNL, the display element DE comprises, for example, an electrophoretic element to be explained below, displays at least white and black, and can also display gray. The photodetector PR is, for example, a photodiode, and receives light projected to the display portion DA and outputs a photodetection signal, which is an electric signal. The pixels PX are not disposed on the non-display portion NDA but the photodetectors PR alone may be disposed on the non-display portion NDA.

The controller CTR comprises a display controller 40, a display side scanner 41, a display signal driver 42, a photodetection side scanner 43, a photodetection signal receiver 45, and a signal processor 46.

The display controller 40 temporarily holds a display signal supplied from the signal processor 46, controls the display side scanner 41 and the display signal driver 42 which drive the display elements DE, and controls the photodetection side scanner 43 which drives the photodetectors PR. More specifically, the display controller 40 outputs the display timing control signal to the display side scanner 41, outputs the photodetection timing control signal to the photodetection side scanner 43, and outputs the held display signal to the display signal driver 42.

The display side scanner 41 selects the pixel PX for display, in accordance with the display timing control signal output from the display controller 40. More specifically, the display side scanner 41 supplies a display selection signal via a display gate line GA connected to the pixel PX. When the pixel PX is selected based on the display selection signal, display data becomes capable of being supplied to the display element DE.

The display signal driver 42 supplies the display data to the pixel PX for display, in accordance with the display signal output from the display controller 40. More specifically, the display signal driver 42 supplies a voltage corresponding to the display data via a data supply line DL connected to the pixel PX. The display side scanner 41 and the display signal driver 42 thus collaborate executing a line-sequential operation, and the image is thereby displayed on the display panel PNL.

The photodetection side scanner 43 selects the pixel PX for photodetection, in accordance with the photodetection timing control signal output from the display controller 40. More specifically, the photodetection side scanner 43 supplies a photodetection selection signal via a photodetection gate line GB connected to the pixel PX. When the pixel PX is selected based on the photodetection selection signal, the pixel PX outputs the photodetection signal from the photodetector PR to the photodetection signal receiver 45 via the output line OL. The photodetection signal has a level corresponding to an intensity of the light projected onto the display portion DA. The photodetection signal acquired by a photodetection signal receiver 45 is output to the signal processor 46.

The signal processor 46 generates the display signal, based on the photodetection signal output from the photodetection signal receiver 45. The signal processor 46 can hold a black level corresponding to a threshold value which allows the display element DE to display black and a white level corresponding to a threshold value which allows the display element DE to display white, which will be explained below in detail. The signal processor 46 supplies the generated display signal to the display controller 40.

Figure 4:
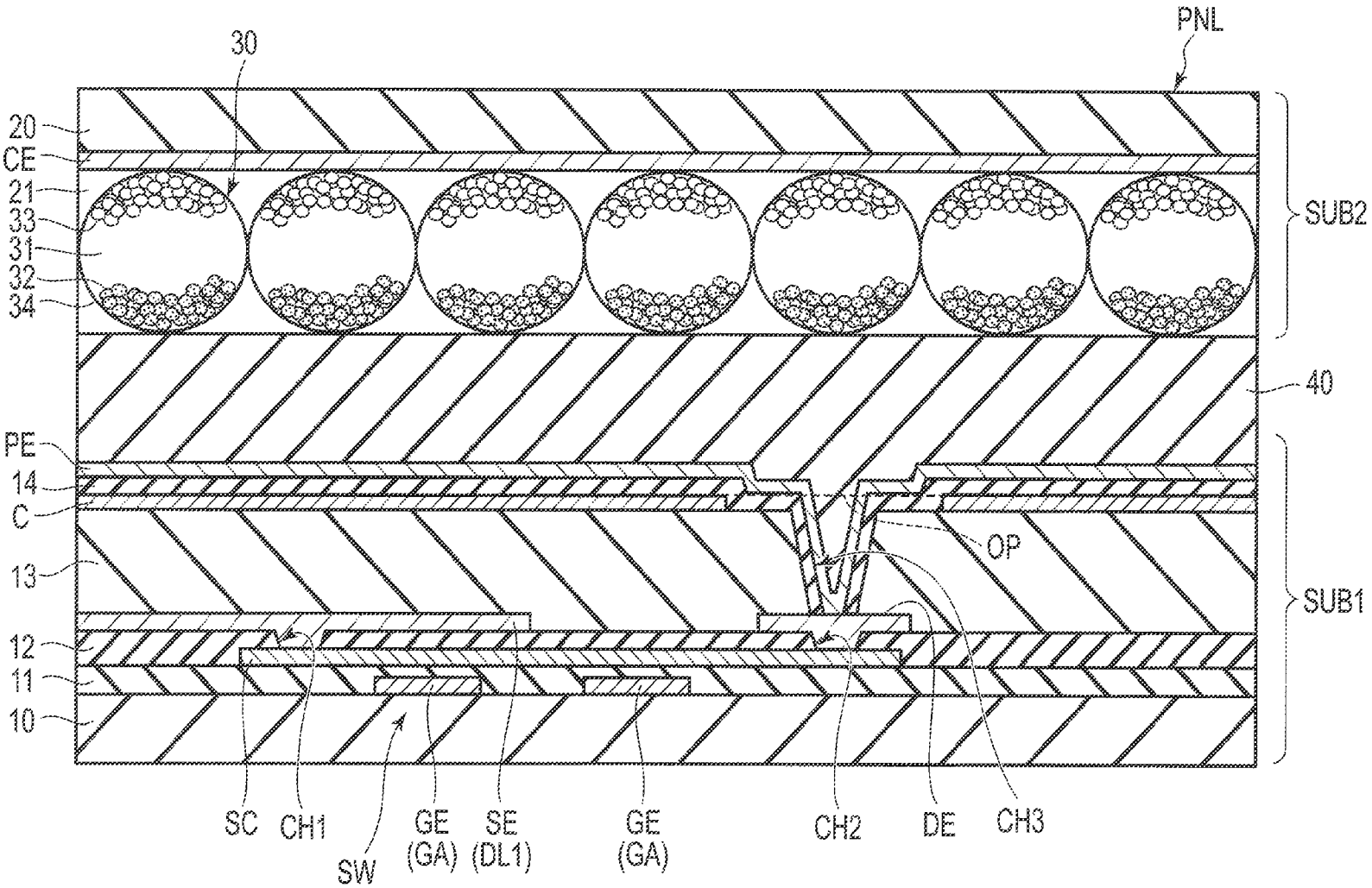
FIG. 4 is a cross-sectional view showing a display element DE of the display panel PNL shown in FIG. 1.

FIG. 4 is a cross-sectional view showing a display element DE of the display panel PNL shown in FIG. 1. The display panel PNL comprises a first substrate SUB1 and a second substrate SUB2. The first substrate SUB1 and the second substrate SUB2 are bonded together by an adhesive layer 40. The projector 2 shown in FIG. 1 is assumed to be positioned above the second substrate SUB2 in the depicted cross-section. The first substrate SUB1 comprises a basement 10, insulating films 11 to 14, a switching element SW, a conductive layer C, and a pixel electrode PE. The gate electrode GE which is integral with the display gate line GA, is located on the basement 10 and is covered with the insulating film 11. The semiconductor layer SC is located on the insulating film 11 and is covered with the insulating film 12. A source electrode SE which is integral with the data supply line DL, and a drain electrode DE are located on the insulating film 12, and are covered with an insulating film 13. The source electrode SE is in contact with the semiconductor layer SC through a contact hole CH1 penetrating the insulating film 12. The drain electrode DE is in contact with the semiconductor layer SC through a contact hole CH2 penetrating the insulating film 12.

The conductive layer C is located on the insulating film 13 and is covered with the insulating film (inorganic insulating film) 14. In addition, the conductive layer C functions as a capacitive electrode for securing a storage capacitance between the conductive layer C and the pixel electrode PE. The conductive layer C has the same electric potential as, for example, the common electrode CE. The pixel electrode PE is located on the insulating film 14. The pixel electrode PE is opposed to the conductive layer C via the insulating film 14. The pixel electrode PE is in contact with the drain electrode DE through a contact hole CH3 penetrating the insulating films 13 and 14, at a position which overlaps an opening portion OP of the conductive layer C. Either of the conductive layer C and the pixel electrode PE is a reflective electrode while the other is a transparent electrode. In a case where the conductive layer C is a multilayer structure, at least one layer is a reflective electrode. Such a reflective electrode functions as, for example, a reflective film which reflects light projected from the second substrate SUB2 side, and also functions as a light-shielding film which blocks light traveling toward the switching element SW from the second substrate SUB2 side.

The second substrate SUB2 comprises a basement 20, a common electrode CE, and an electrophoretic element 21. The common electrode CE is located between the basement 20 and the electrophoretic element 21. The common electrode CE is formed over substantially the entire region of the display portion DA shown in FIG. 1. The electrophoretic element 21 is formed of microcapsules 30 arranged with substantially no gaps formed therebetween. The adhesive layer 40 is located between the pixel electrode PE and the electrophoretic element 21.

The microcapsule 30 is, for example, a spherical body having a particle diameter of approximately 50 μm to 100 μm. In the example illustrated, a number of microcapsules 30 are arranged between one pixel electrode PE and the common electrode CE, due to the constraints of a scale of the drawing, but approximately one to ten microcapsules 30 are arranged in a square pixel PX having each side of approximately several hundreds of micrometers.

The microcapsules 30 comprise a dispersion medium 31, black particles 32, and white particles 33. The dispersion medium 31 is a liquid for dispersing the black particles 32 and the white particles 33 in the microcapsule 30. The black particles 32 are, for example, particles formed of black pigment and are, for example, positively charged. The white particles 33 are, for example, particles formed of white pigment and are, for example, negatively charged. Instead of the black particles 32 and the white particles 33, for example, pigments having colors such as red, green, blue, yellow, cyan or magenta may be used.

In the above-constituted display panel PNL, the display element DE is composed of the pixel electrode PE, the common electrode CE, and the electrophoretic element 21. When the display element DE is urged to execute black display, the pixel electrode PE is held at a relatively higher potential than the common electrode CE. That is, when a potential of the common electrode CE is referred to as a reference potential, the pixel electrode PE is held in positive polarity. Consequently, the positively charged black particles 32 are attracted to the common electrode CE while the negatively charged white particles 33 are attracted to the pixel electrode PE. As a result, black is visually recognized when the display element DE is observed from the common electrode CE side.

Meanwhile, when the pixel PX is urged to execute white display, the pixel electrode PE is held in negative polarity when the potential of the common electrode CE is referred to as the reference potential. Consequently, the negatively charged white particles 33 are attracted to the common electrode CE side while the positively charged black particles 32 are attracted to the pixel electrode PE. As a result, white is visually recognized when the display element DE is observed.

When the display element DE is urged to display gray, for example, the black particles 32 and the white particles 33 are attracted to the common electrode CE side by varying the electric potential of at least one of the pixel electrode PE and the common electrode CE to a pulse potential. As a result, gray is visually recognized when the display element DE is observed.

Figure 5:
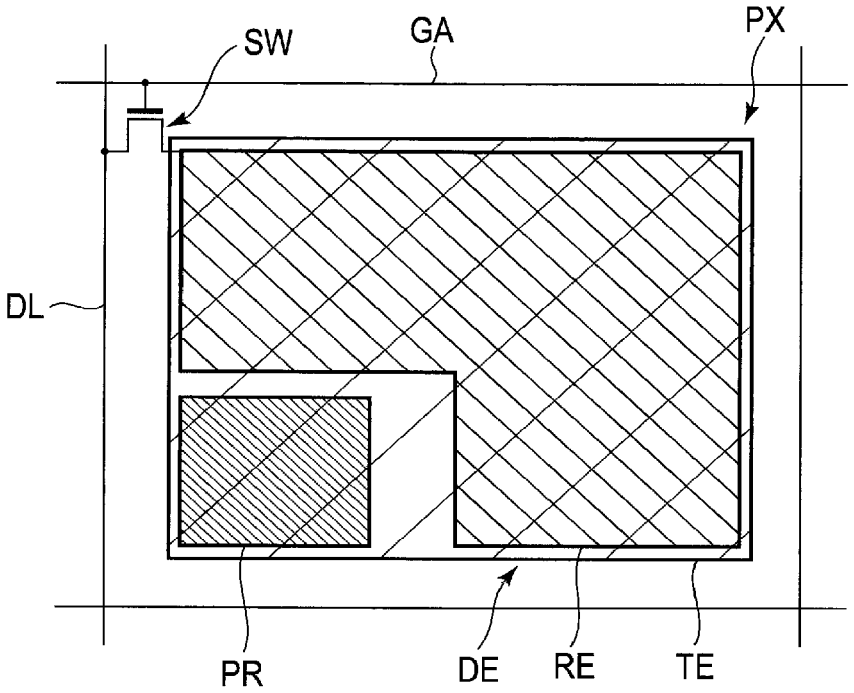
FIG. 5 is a plan view showing a configuration example of a pixel PX.

FIG. 5 is a plan view showing a configuration example of a pixel PX. Only main portions of the first substrate SUB1 necessary for the explanations will be depicted. The reflective electrode RE does not overlap the photodetector PR in planar view. A transparent electrode TE overlaps the reflective electrode RE. In the example illustrated, the transparent electrode TE overlaps the photodetector PR but may not overlap the photodetector PR. In a case where the pixel electrode PE shown in FIG. 4 is the transparent electrode TE, the electrophoretic element can be driven in not only the region which overlaps the reflective electrode RE, but also the region which overlaps the photodetector PR. The pixel electrode PE may be the reflective electrode RE.

Figure 6:
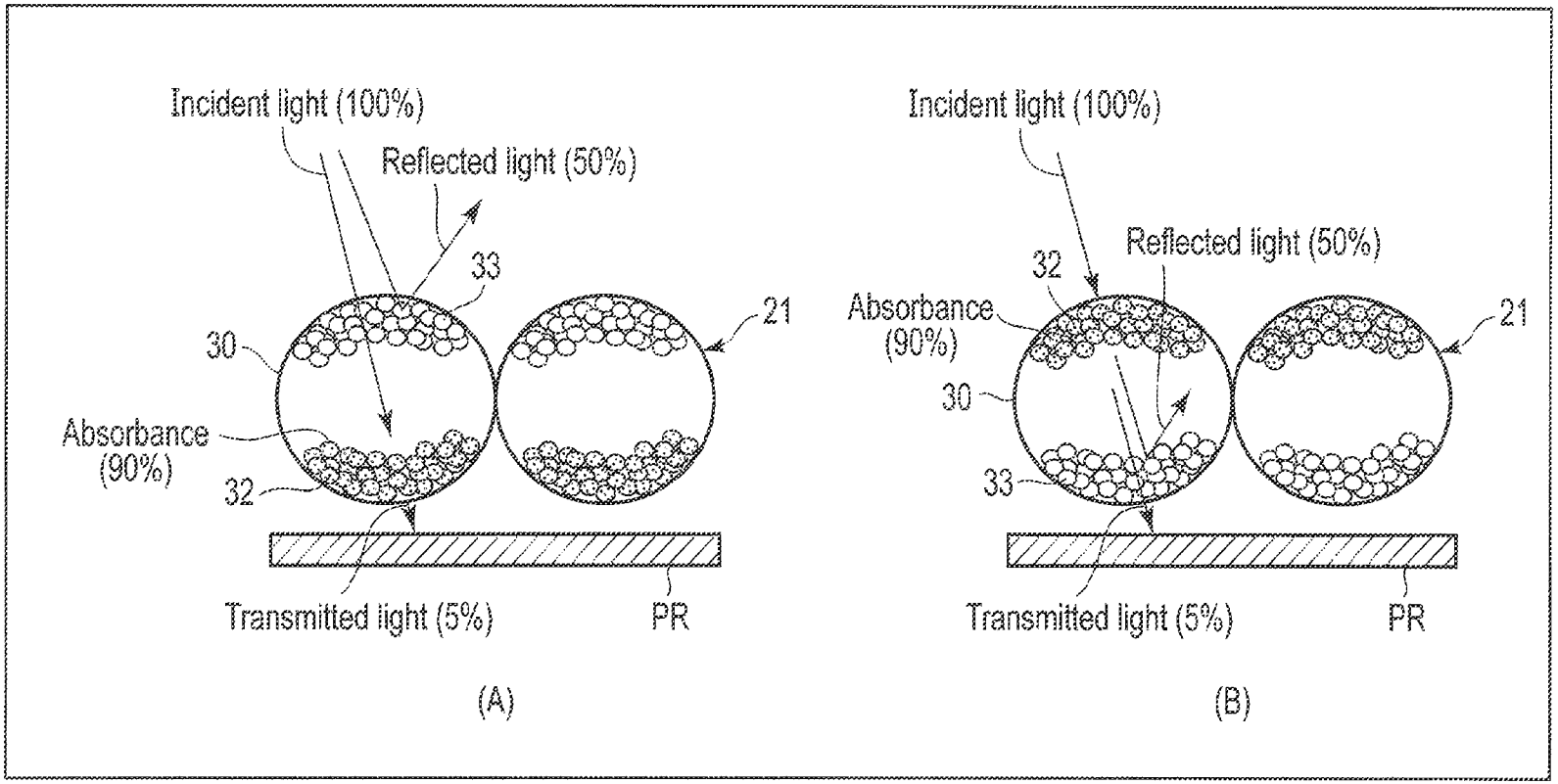
FIG. 6 is an illustration for explanation of light received by a photodetector PR via a microcapsule 30.

FIG. 6 is an illustration for explanation of light received by a photodetector PR via a microcapsule 30. FIG. 6(A) shows the microcapsules 30 in the white display state. FIG. 6(B) shows the microcapsules 30 in the black display state. The microcapsules 30 have a constant transmittance to incident light irrespective of the dispersed state of the black particles 32 and the white particles 33. The transmittance of the microcapsules 30 is in a range between approximately 3% and 10%, for example, 5%. The other light is absorbed into the black particles 32, reflected on the white particles 33, or scattered inside the microcapsules 30. For example, the reflectance on the white particles 33 is approximately 50% and the absorbance on black particles 32 is approximately 90%.

In the example shown in FIG. 6(A), light of 50% of the incident light (100%) is reflected on upper-layer white particles 33. Light of 90% (45% of incident light) of the light of remaining 50% is absorbed into lower-layer black particles 32. For this reason, the light of remaining 5% is transmitted through the microcapsules 30 and received by the photodetector PR.

In the example shown in FIG. 6(B), light of 90% of the incident light (100%) is absorbed into upper-layer black particles 32. Light of 50% (5% of incident light) of the light of remaining 10% is reflected on lower-layer white particles 33. For this reason, the light of remaining 5% is transmitted through the microcapsules 30 and received by the photodetector PR.

Thus, the quantity of photodetection at the photodetector PR is not influenced by the disperse state of the black particles 32 and the white particles 33 or the display state on the display element. Therefore, the photodetector PR outputs the photodetection signal, based on the quantity of photodetection depending on the brightness of the incident light on the microcapsules 30, irrespective of the display state of the pixel.

Figure 7:
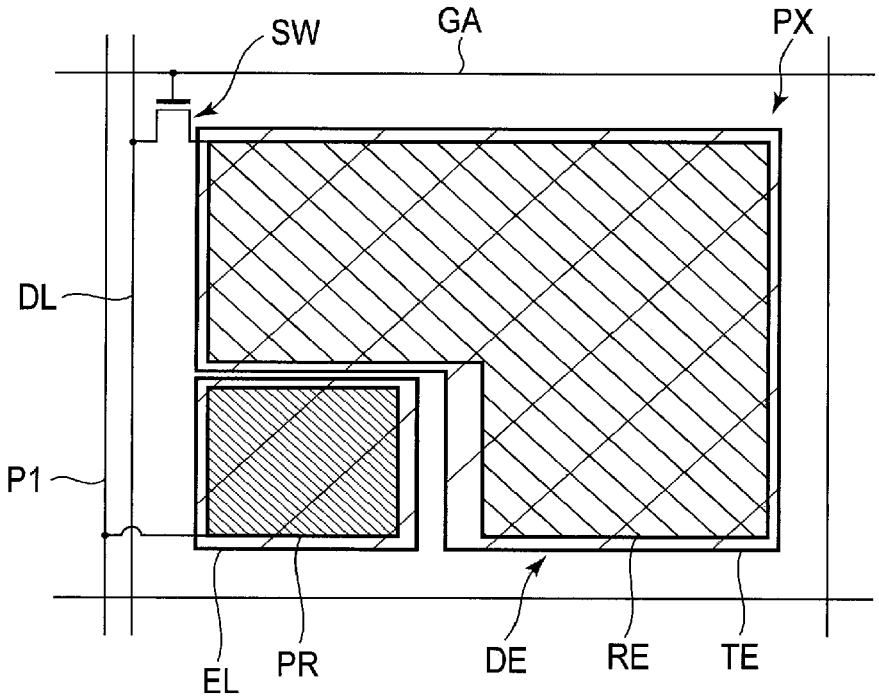
FIG. 7 is a plan view showing another configuration example of the pixel PX.

FIG. 7 is a plan view showing another configuration example of the pixel PX. The configuration example shown in FIG. 7 is different from the configuration example shown in FIG. 5 with respect to a feature of comprising the transparent electrode EL which overlaps the photodetector PR. The transparent electrode EL is formed of, for example, the same material as the transparent electrode TE of the display element DE. The transparent electrode EL is positioned remote from the transparent electrode TE. In addition, the transparent electrode EL is disposed in the same layer as the transparent electrode TE (pixel electrode PE or conductive layer C) and is located below the electrophoretic element 21 as shown in FIG. 4. The transparent electrode EL is electrically connected to a line P1. The electric potential of the transparent electrode EL is, for example, a predetermined fixed potential. The electric potential of the transparent electrode EL may be varied cyclically. The electric potential of the transparent electrode EL is different from, for example, the electric potentials of the transparent electrode TE and the common electrode CE.

The electric potential of the transparent electrode EL is held at a relatively lower potential than the common electrode CE and the region which overlaps the transparent electrode EL is therefore held to be the white display state at any time as shown in FIG. 6(A). Alternatively, the electric potential of the transparent electrode EL is held at a relatively higher potential than the common electrode CE and the region which overlaps the transparent electrode EL is therefore held to be the black display state at any time as shown in FIG. 6(B). Alternatively, the electric potential of the transparent electrode EL is varied cyclically and the region which overlaps the transparent electrode EL is therefore varied cyclically to the white display state and the black display state.

In any way, the transparent electrodes EL in all of the pixels PX are electrically connected to the line P1, and the regions which overlap all of the photodetectors PR become the white display state or the black display state. As a result, the photodetection state in all of the photodetectors PR on the display panel is homogenized.

Figure 8:
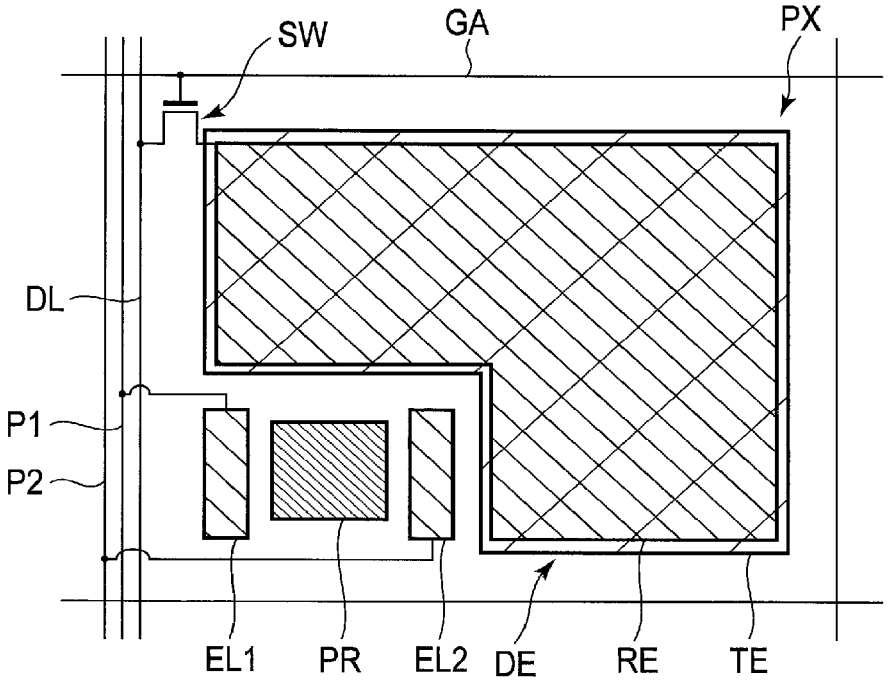
FIG. 8 is a plan view showing the other configuration example of the pixel PX.

FIG. 8 is a plan view showing the other configuration example of the pixel PX. The configuration example shown in FIG. 8 is different from the configuration example shown in FIG. 5 with respect to a feature of comprising the first electrode EL1 and the second electrode EL2 opposed to each other through the photodetector PR. The first electrode EL1 and the second electrode EL2 may be formed of the same material as the transparent electrode TE or the same material as the reflective electrode RE. The first electrode EL1 is electrically connected to the line P1, and the second electrode EL2 is electrically connected to a line P21. The electric potential of the first electrode EL1 is different from the electric potential of the second electrode EL2, and a potential difference is formed between the first electrode EL1 and the second electrode EL2. The electric potential of the first electrode EL1 may be held to be relatively lower than the electric potential of the second electrode EL2 or relatively higher than the electric potential of the second electrode EL2. Alternatively, the state in which the electric potential of the first electrode EL1 is held to be lower than the electric potential of the second electrode EL2 and the state in which the electric potential of the first electrode EL1 is held to be higher than the electric potential of the second electrode EL2 may be changed alternately. A lateral electric field is thereby formed between the first electrode EL1 and the second electrode EL2.

Figure 9:
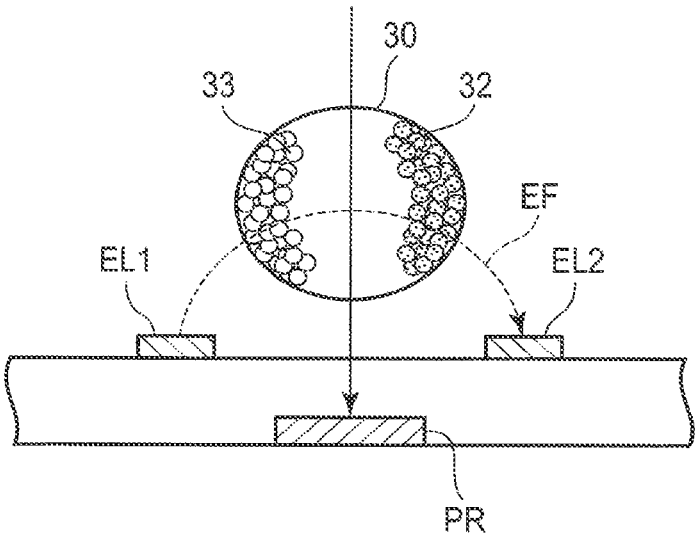
FIG. 9 is a cross-sectional view for explanation of an effect of a lateral electric field in the configuration example shown in FIG. 8.

FIG. 9 is a cross-sectional view for explanation of an effect of a lateral electric field in the configuration example shown in FIG. 8. In the example illustrated, the electric potential of the first electrode EL1 is held to be relatively higher than the electric potential of the second electrode EL2. A lateral electric field flowing from the first electrode EL1 to the second electrode EL2 is thereby formed. When such a lateral electric field EF acts on the microcapsules 30, the negatively charged white particles 33 are attracted to the first electrode EL1 while the positively charged black particles 32 are attracted to the second electrode EL2. Therefore, in the region which overlaps the photodetector PR, the density of the black particles 32 and the white particles 33 is lowered and the transmittance of the microcapsules 30 is enhanced as compared with the case explained with reference to FIG. 6. As a result, light is made incident on each photodetector not through the black particles or white particles of the microcapsules, and the photodetection sensitivity of the display panel is enhanced.

Next, the operations of the display device DSP shown in FIG. 3 will be explained.

Figure 10:
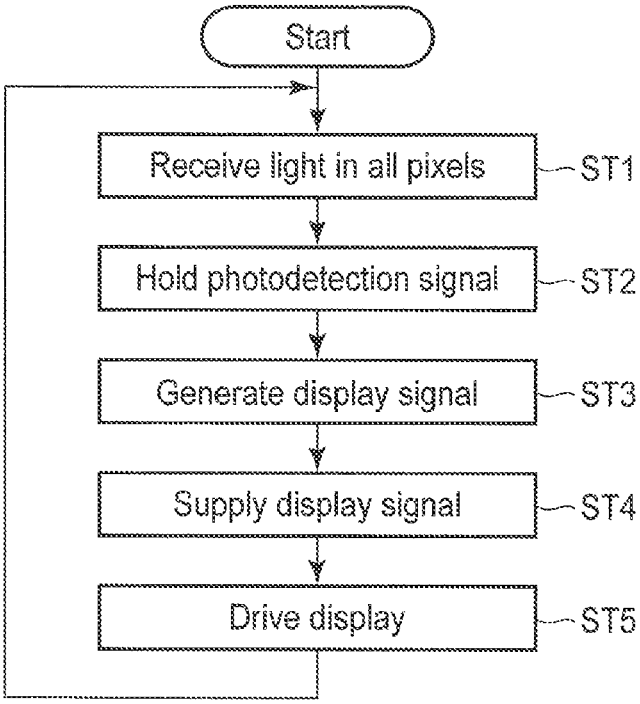
FIG. 10 is a flowchart for explanation of an operation of the display device DSP.

FIG. 10 is a flowchart for explanation of an operation of the display device DSP. The display device DSP receives light of the projected image I2 in all pixels PX of the display portion DA at power-on (step ST1). The photodetector PR included in each of all of the pixels PX receives the light of the projected image I2 and generates the photodetection signal of the level corresponding to the light intensity. The signal processor 46 holds the photodetection signal output from each photodetector PR (step ST2). The signal processor 46 compares the level of the photodetection signal for one pixel with the black level or white level explained below to generate the display signal (step ST3). The signal processor 46 supplies the generated display signal to the display controller 40 (step ST4). The display controller 40 drives the display side scanner 41 and the display signal driver 42 such that each of the pixels PX displays white, black, gray, and the like based on the display signal (step ST5).

Next, a control example including the method of generating the display signal in step ST3 will be explained.

Figure 11:
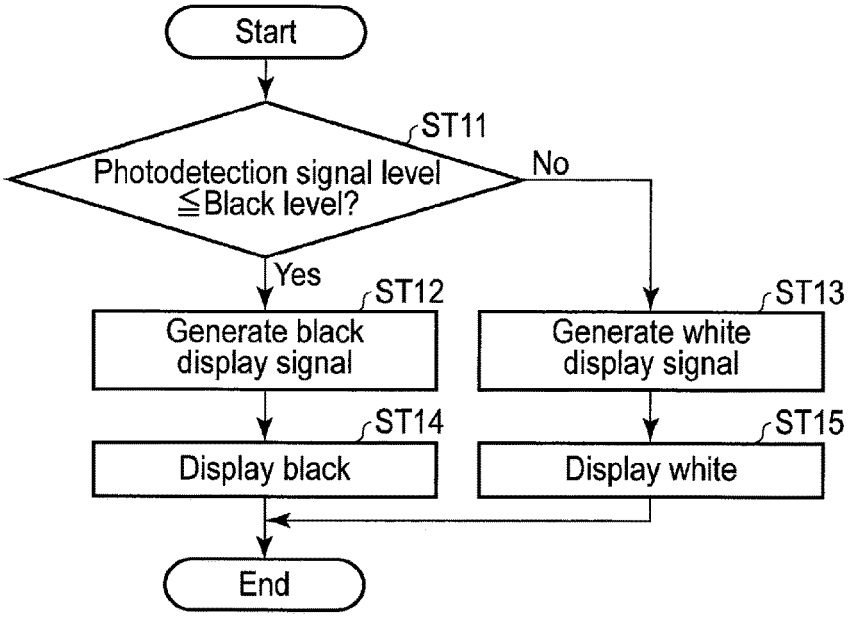
FIG. 11 is a flowchart for explanation of a first control example.

FIG. 11 is a flowchart for explanation of a first control example. The signal processor 46 holds a black level. The black level may be a value preset as an initial value or a value set by a manner explained below.

The signal processor 46 compares the level of the photodetection signal with the black level (step ST11). When the signal processor 46 determines that the level of the photodetection signal is lower than or equal to the black level (YES in step ST11), the signal processor 46 generates the black display signal (step ST12). The black display signal is a display signal for allowing the display element DE to display black. When the signal processor 46 determines that the level of the photodetection signal is higher than the black level (NO in step ST11), the signal processor 46 generates the white display signal (step ST13). The white display signal is a display signal for allowing the display element DE to display white.

The display element DE of the same pixel PX as the photodetector PR which outputs the photodetection signal to be compared in step ST11 is driven based on the black display signal generated in step ST12 or the white display signal generated in step ST13. The display element DE displays black when the display element DE is driven based on the black display signal (step ST14), and the display element DE displays white when the display element DE is driven based on the white display signal (step ST15).

In the first control example, the display element DE which overlaps a black image of the projected image I2 displays black, and the display element DE which overlaps a white image, a gray image or a color image of the projected image I2 displays white.

Figure 12:
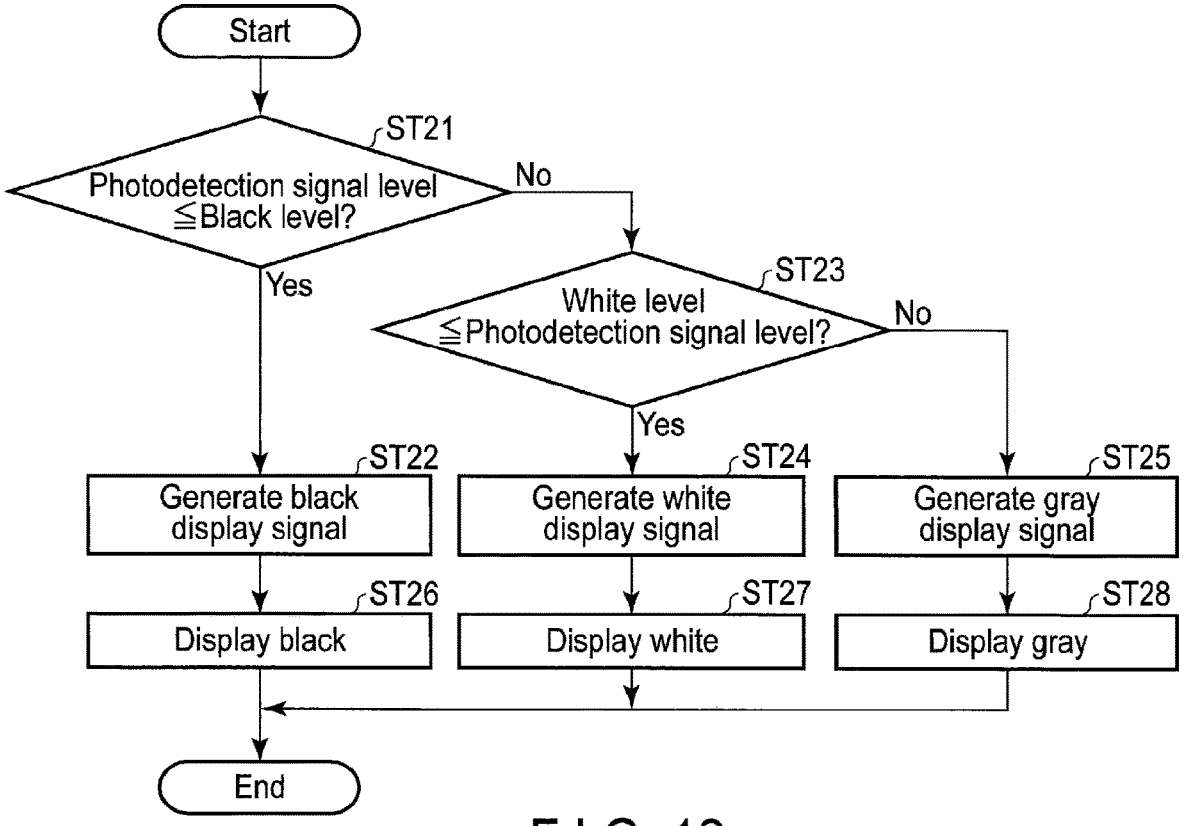
FIG. 12 is a flowchart for explanation of a second control example.

FIG. 12 is a flowchart for explanation of a second control example. The second control example shown in FIG. 12 is different from the first control example shown in FIG. 11 with respect to a feature that the signal processor 46 holds the black level and the white level. The white level may be a value preset as an initial value or a value set by a manner explained below.

The signal processor 46 compares the level of the photodetection signal with the black level (step ST21). When the signal processor 46 determines that the level of the photodetection signal is lower than or equal to the black level (YES in step ST21), the signal processor 46 generates the black display signal (step ST22).

When the signal processor 46 determines that the level of the photodetection signal is higher than the black level (NO in step ST21) and higher than or equal to the white level (YES in step ST23), the signal processor 46 generates the white display signal (step ST24).

When the signal processor 46 determines that the level of the photodetection signal is higher than the black level (NO in step ST21) and lower than the white level (NO in step ST23), the signal processor 46 generates the gray display signal (step ST25). The gray display signal is a display signal for allowing the display element DE to display gray.

The display element DE is driven, based on any one of the black display signal generated in step ST22, the white display signal generated in step ST23, and the gray display signal generated in step ST24. That is, the display element DE displays black when the display element DE is driven based on the black display signal (step ST26), the display element DE displays white when the display element DE is driven based on the white display signal (step ST27), and the display element DE displays gray when the display element DE is driven based on the gray display signal (step ST28).

In the second control example, the display element DE which overlaps a black image of the projected image I2 displays black, the display element DE which overlaps a white image and a color image of the projected image I2 displays white, and the display element DE which overlaps a gray image of the projected image I2 displays gray.

Next, a method of setting the black level in the first control example and the second control example will be explained.

Figure 13:
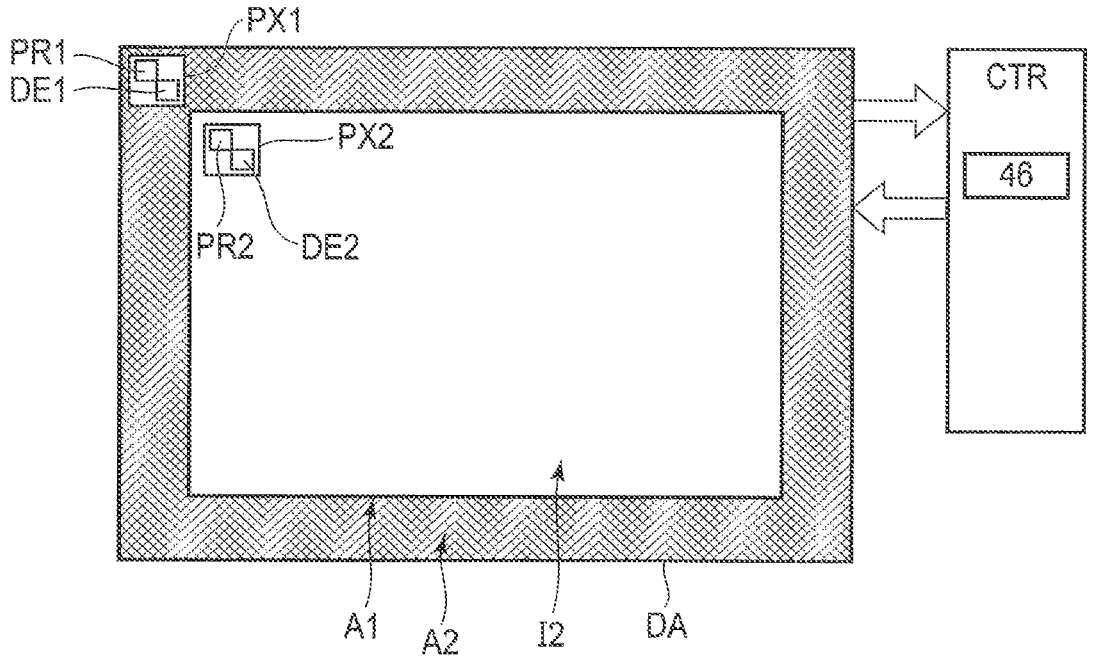
FIG. 13 is a diagram for explanation of a first setting method of a black level.

FIG. 13 is a diagram for explanation of a first setting method of a black level. In the display portion DA, the second region A2 includes a first pixel PX1. The first pixel PX1 comprises a first display element DE1 and a first photodetector PR1. The first region A1 where the projected image I2 is projected includes a second pixel PX2. The second pixel PX2 comprises a second display element DE2 and a second photodetector PR2.

In the controller CTR, the signal processor 46 sets the level of the photodetection signal from the first photodetector PR1 to the black level and holds the level. The first display element DE1 is controlled by the controller CTR to display black.

The second display element DE2 is controlled by the controller CTR as explained with reference to the flowcharts of FIG. 10 to FIG. 12, and driven by the display signal generated based on the photodetection signal from the second photodetector PR2.

According to the first setting method, the black level can be set by using the first pixel PX1 of the second region A2 where the projected image I2 is not projected, of the display portion DA. In addition, when the other display element located in the second region A2 also displays black similarly to the first display element DE1, the periphery of the projected image I2 is displayed in black in the display portion DA, and the visibility of the projected image I2 can be improved.

Figure 14:
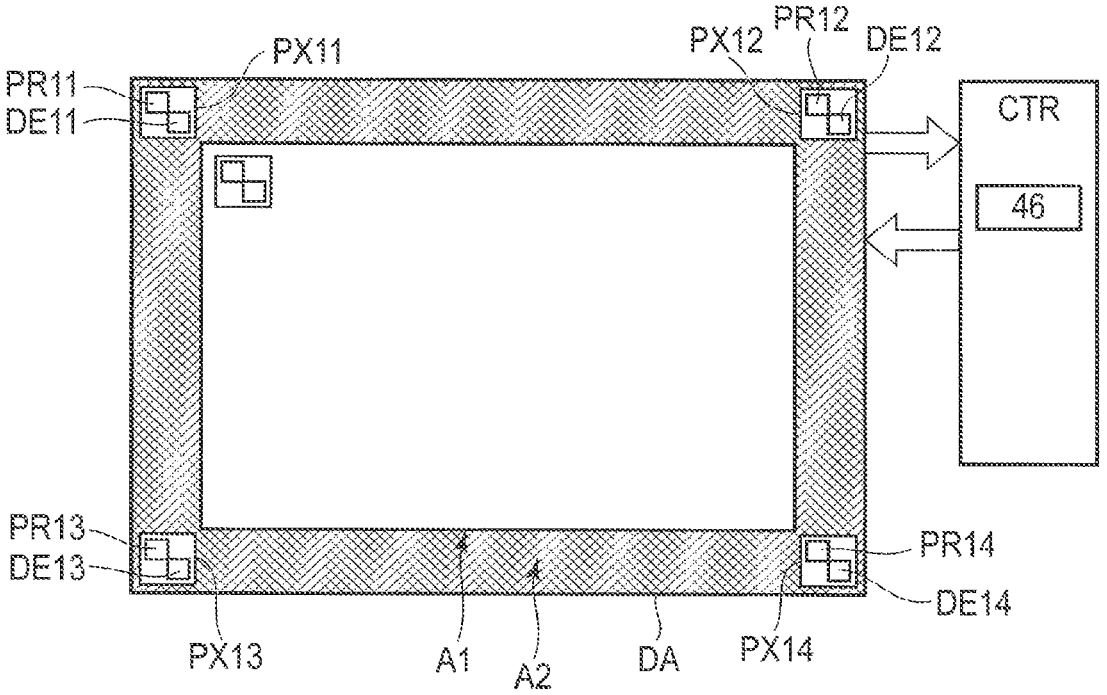
FIG. 14 is a diagram for explanation of a modified example of the first setting method.

FIG. 14 is a diagram for explanation of a modified example of the first setting method. The second region A2 includes first pixels PX11 to PX14. The first pixels PX11 to PX14 are located near, for example, four corners of the display portion DA.

The signal processor 46 sets the black level based on the levels of the photodetection signals output from the respective first photodetectors PR11 to PR14, and holds the black level. Each of the first display elements DE11 to DE14 is controlled by the controller CTR to display black.

According to the modified example, the black level according to the mounting condition of the display device DSP, i.e., the brightness of the surrounding of the display device DSP can be set as compared with setting the black level based on the photodetection signal from the single first photodetector PR1 located in the second region A2.

Figure 15:
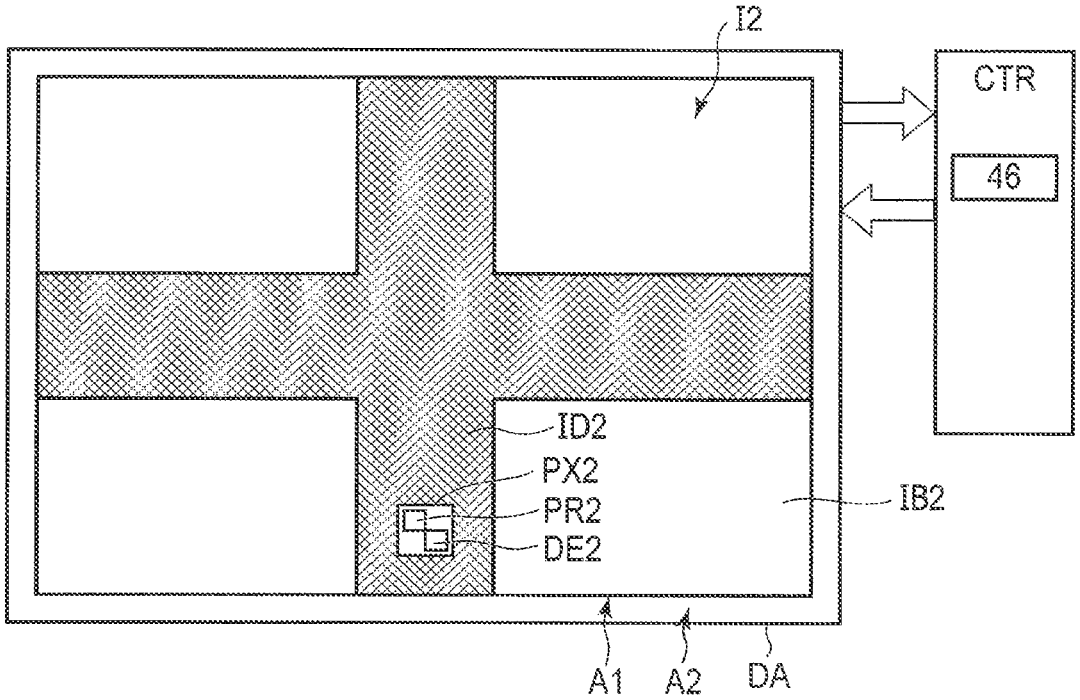
FIG. 15 is a diagram for explanation of a second setting method of the black level.

FIG. 15 is a diagram for explanation of a second setting method of the black level. In the first region A1, the second pixel PX2 overlaps the dark portion ID2 which is the darkest in the projected image I2.

The signal processor 46 can specify the second pixel PX2 overlapping the dark portion ID2 which is the darkest, by comparing the levels of the photodetection signals from the photodetectors PR of all of the pixels PX. The signal processor 46 sets the level of the photodetection signal from the second photodetector PR2 of the specified second pixel PX2 to the black level and holds the level. The second display element DE2 is controlled by the controller CTR to display black.

According to the second setting method, every time the projected image I2 is changed the black level can be set in accordance with the dark portion ID2 which is the darkest in the projected image I2. For this reason, even if the projected image I2 is changed the display quality of a high contrast ratio can be obtained.

Next, a method of setting the white level in the above-explained second control example will be explained.

Figure 16:
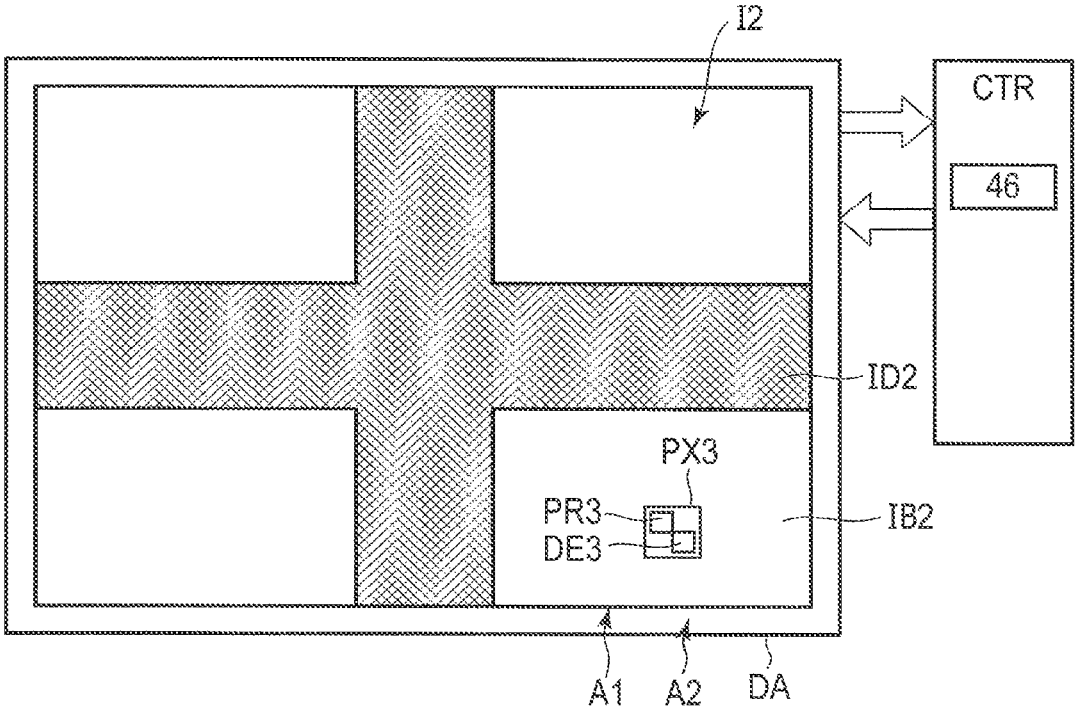
FIG. 16 is a diagram for explanation of a third setting method of a white level.

FIG. 16 is a diagram for explanation of a third setting method of the white level. The first region A1 includes a third pixel PX3. The third pixel PX3 comprises a third display element DE3 and a third photodetector PR3. In the first region A1, the third pixel PX3 overlaps the bright portion IB2 which is the brightest in the projected image I2.

The signal processor 46 can specify the third pixel PX3 overlapping the bright portion IB2 which is the brightest, by comparing the levels of the photodetection signals from the photodetectors PR of all of the pixels PX. The signal processor 46 sets the level of the photodetection signal from the third photodetector PR3 of the specified third pixel PX3 to the white level and holds the level. The third display element DE3 is controlled by the controller CTR to display white.

According to the third setting method, every time the projected image I2 is changed the white level can be set in accordance with the bright portion IB2 which is the brightest in the projected image I2. For this reason, even if the projected image I2 is changed the display quality of a high contrast ratio can be obtained.

Next, a gradation determination method in which the display element DE displays gray will be explained.

Figure 17:
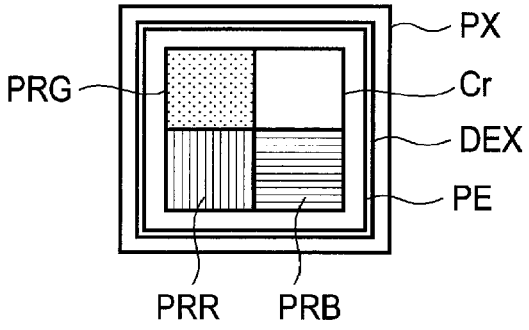
FIG. 17 is a plan view showing another configuration example of the pixel PX.

FIG. 17 is a plan view showing another configuration example of the pixel PX. The pixel PX comprises a pixel circuit Cr including the switching element SW, a first photodetector PRR, a second photodetector PRG, a third photodetector PRB, and a display element DEX. The first photodetector PRR receives light of a mainly red wavelength and outputs the photodetection signal. The second photodetector PRG receives light of a mainly green wavelength and outputs the photodetection signal. The third photodetector PRB receives light of a mainly blue wavelength and outputs the photodetection signal. The pixel electrode PE of the display element DEX overlaps the pixel circuit Cr, the first photodetector PRR, the second photodetector PRG, and the third photodetector PRB.

Figure 18:
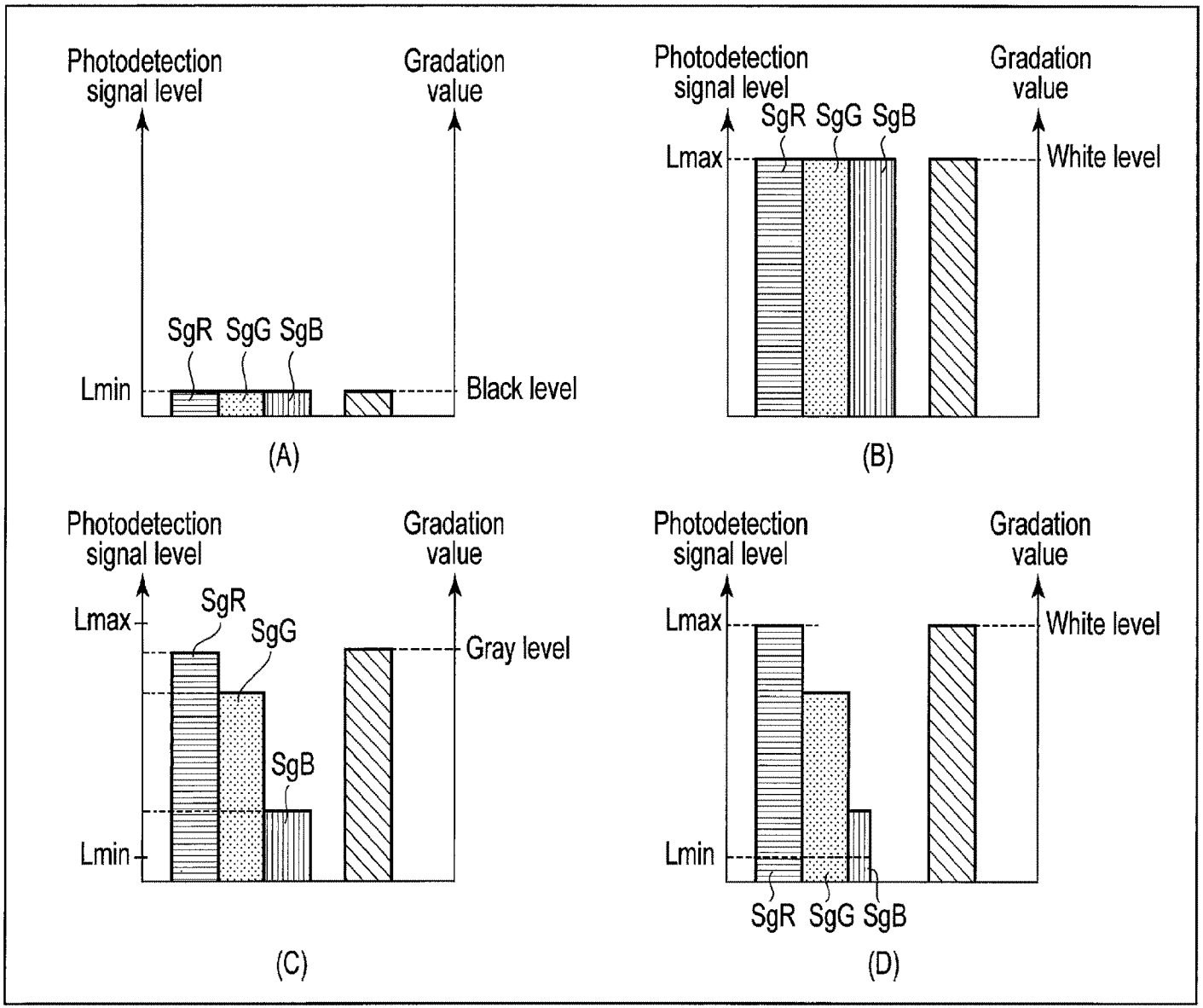
FIG. 18 is an illustration for explanation of a gradation determination method.

FIG. 18 is an illustration for explanation of a gradation determination method. FIG. 18(A), FIG. 18(B), FIG. 18(C), and FIG. 18(D) show photodetection signal SgR from the first photodetector PRR, photodetection signal SgG from the second photodetector PRG, and photodetection signal SgB from the third photodetector PRB. The level of the photodetection signal SgR indicates brightness and darkness of the light of the red wavelength, the level of the photodetection signal SgG indicates brightness and darkness of the light of the green wavelength, and the level of the photodetection signal SgB indicates brightness and darkness of the light of the blue wavelength. That is, the level of each photodetection signal indicates a gradation value.

FIG. 18(A) shows the photodetection signals SgR, SgG, and SgB output in a case where the pixel PX shown in FIG. 17 overlaps the dark portion ID2 which is the darkest in the projected image I2. In the example illustrated, the level of each of the photodetection signals SgR, SgG, and SgB is the minimum level Lmin. In this case, the signal processor 46 sets the black level which is the minimum gradation value as the gradation value, based on the level Lmin of the photodetection signals SgR, SgG, and SgB, similarly to the case explained with reference to FIG. 15. At this time, the display element DEX displays black, based on the black display signal.

FIG. 18(B) shows the photodetection signals SgR, SgG, and SgB output in a case where the pixel PX shown in FIG. 17 overlaps the bright portion IB2 which is the brightest in the projected image I2. In the example illustrated, the level of each of the photodetection signals SgR, SgG, and SgB is the maximum level Lmax. In this case, the signal processor 46 sets the white level which is the maximum gradation value as the gradation value, based on the level Lmax of the photodetection signals SgR, SgG, and SgB, similarly to the case explained with reference to FIG. 16. At this time, the display element DEX displays white, based on the white display signal.

FIG. 18(C) shows the photodetection signals SgR, SgG, and SgB output in a case where the pixel PX shown in FIG. 17 overlaps a portion which has brightness between the dark portion ID2 and the bright portion IB2 in the projected image I2. In the example illustrated, the level of each of the photodetection signals SgR, SgG, and SgB is higher than the minimum level Lmin and lower than the maximum level Lmax. In this case, the signal processor 46 sets the gray gradation value between the black level and the white level, based on the levels of the photodetection signals SgR, SgG, and SgB. For example, when the black-level gradation value is 0 and the white-level gradation value is 100, the gray gradation value can be set within a range higher than 0 and lower than 100.

In the example illustrated in FIG. 18(C), the level of the photodetection signal SgR is higher than the levels of the other photodetection signals. For this reason, the signal processor 46 sets the gradation value which should be displayed on the display element DEX, based on the level of the photodetection signal SgR. However, the signal processor 46 sets the gradation value which is higher by at least one gradation value than the gradation value closest to the level of the photodetection signal SgR, as the gradation value which should be displayed on the display element DEX. Reduction in chroma of the projected image I2 can be thereby suppressed when the display element DEX overlaps the projected image I2.

FIG. 18(D) shows the other examples of the photodetection signals SgR, SgG, and SgB output in a case where the pixel PX shown in FIG. 17 overlaps a portion which has brightness between the dark portion ID2 and the bright portion IB2. In the example illustrated, the level of each of the photodetection signals SgG and SgB is higher than the minimum level Lmin and lower than the maximum level Lmax. In contrast, the level of the photodetection signal SgR is the maximum level Lmax. In this case, the signal processor 46 sets the white level which is the maximum gradation value as the gradation value, based on the level Lmax of the photodetection signal SgR. In other words, when the level of at least one of the photodetection signals SgR, SgG, and SgB is the maximum level Lmax, the gradation value is set at the white level. At this time, the display element DEX displays white, based on the white display signal.

Figure 19:
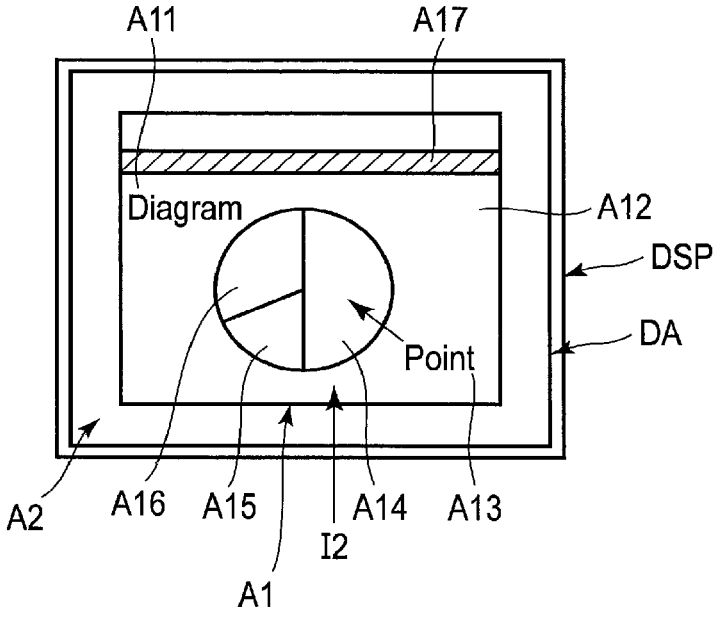
FIG. 19 is a diagram for explanation of a projected image I2 and a display state of a display portion DA.

FIG. 19 is a diagram for explanation of a projected image I2 and a display state of a display portion DA. In the second region A2 where the projected image I2 is not projected, in the display portion DA, the gradation value is set at the black level as shown in FIG. 18(A). For this reason, each display element DE of the second region A2 displays black.

In the first region A1 where the projected image I2 is projected, the gradation value is set based on the image projected in each pixel. For example, the first region A1 includes a region A11 where a black character string "diagram" is projected, a region A12 where a white background is projected, a region A13 where a red character string "Point" is projected, regions A14 to A16 where divided regions of a circle graph in different colors are projected, a region A17 where a decorated portion is projected, and the like, of the projected image I2.

In the pixel PX of the region A11, the level of each of the photodetection signals SgR, SgG, and SgB is the minimum level Lmin as shown in FIG. 18(A). The gradation value of the region A11 is therefore set at the black level. Each display element DE of the region A11 displays black based on the photodetection signal.

In the pixel PX of the region A12, the level of each of the photodetection signals SgR, SgG, and SgB is the maximum level Lmax as shown in FIG. 18(B). The gradation value of the region A12 is therefore set at the white level. Each display element DE of the region A12 displays white based on the photodetection signal.

In the pixel PX of the region A13, the level of the photodetection signal SgR is the maximum level Lmax as shown in FIG. 18(D). The gradation value of the region A13 is therefore set at the white level. Each display element DE of the region A13 displays white based on the photodetection signal.

In each pixel PX of the regions A14 to A17, the level of each of the photodetection signals SgR, SgG, and SgB is higher than the minimum level Lmin and lower than the maximum level Lmax as shown in FIG. 18(C). In this case, the gradation value is set based on the maximum-level photodetection signal, of the photodetection signals SgR, SgG, and SgB as explained with reference to FIG. 18(C). For example, the gradation values of the regions A14 to A17 are different gray. Each display element DE of the regions A14 to A17 displays gray which corresponds to the set gradation value based on the photodetection signal.

According to the embodiments, as explained above, the display device capable of enhancing the contrast ratio of the projected image can be provided.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device, comprising:

a display panel comprising a display portion onto which a projected image is projected; and a controller which controls the display panel based on the projected image, wherein the display portion comprises a plurality of pixels arranged in matrix, each of the pixels comprises a display element and a photodetector, the controller controls the display element based on a photodetection signal from the photodetector, the display element forms a first reflective region when overlapping a dark portion of the projected image, and forms a second reflective region when overlapping a bright portion of the projected image, a reflectance of the first reflective region is smaller than a reflectance of the second reflective region.

2. The display device of claim 1, wherein the display element displays black when overlapping the dark portion and displays white when overlapping the bright portion.

3. The display device of claim 2, wherein the controller generates a black display signal for the pixel when a level of the photodetection signal of the pixel is lower than or equal to a black level, and generates a white display signal for the pixel when the level of the photodetection signal of the pixel is higher than the black level, and the display element of the pixel is driven based on the black display signal or the white display signal.

4. The display device of claim 2, wherein the controller generates a black display signal for the pixel when a level of the photodetection signal of the pixel is lower than or equal to a black level, generates a white display signal for the pixel when the level of the photodetection signal of the pixel is higher than or equal to a white level, and generates a gray display signal for the pixel when the level of the photodetection signal of the pixel is higher than the black level and lower than the white level, and the display element of the pixel is driven based on any one of the black display signal, the white display signal, and the gray display signal.

5. The display device of claim 2, wherein the display portion includes a first region where the projected image is projected, and a second region where the projected image is not projected and surrounds the first region, the second region includes a first pixel comprising a first display element and a first photodetector, the controller sets a level of a photodetection signal from the first photodetector to a black level, and the first display element displays black based on the photodetection signal.

6. The display device of claim 2, wherein the display portion includes a first region where the projected image is projected, the first region includes a second pixel comprising a second display element and a second photodetector, the second pixel overlaps the dark portion, the controller sets a level of a photodetection signal from the second photodetector to a black level, and the second display element displays black based on the photodetection signal.

7. The display device of claim 2, wherein the display portion includes a first region where the projected image is projected, the first region includes a third pixel comprising a third display element and a third photodetector, the third pixel overlaps the bright portion, the controller sets a level of a photodetection signal from the third photodetector to a white level, and the third display element displays white based on the photodetection signal.

8. The display device of claim 1, wherein the display element comprises a pixel electrode, a common electrode, and an electrophoretic element located between the pixel electrode and the common electrode.

9. The display device of claim 8, wherein the display element further comprises a conductive layer, and an inorganic insulating film located between the pixel electrode and the conductive layer, and one of the conductive layer and the pixel electrode is a reflective electrode and the other is a transparent electrode.

10. The display device of claim 9, wherein the transparent electrode overlaps the photodetector in planar view.

11. The display device of claim 10, wherein the transparent electrode is the pixel electrode.

12. The display device of claim 8, further comprising:

a transparent electrode located between the photodetector and the electrophoretic element, wherein the transparent electrode has an electric potential different from an electric potential of the common electrode.

13. The display device of claim 8, further comprising:

a first electrode and a second electrode opposed to each other through the photodetector in planar view, wherein an electric potential of the first electrode is different from an electric potential of the second electrode.

14. The display device of claim 1, wherein the photodetector comprises a first photodetector outputting a first photodetection signal based on light of a first color, a second photodetector outputting a second photodetection signal based on light of a second color different from the first color, and a third photodetector outputting a third photodetection signal based on light of a third color different from the first color and the second color, the controller generates a white display signal for the pixel when a level of at least one of the first photodetection signal, the second photodetection signal, and the third photodetection signal of the pixel is a maximum level, and the display element displays white based on the photodetection signal.

15. The display device of claim 14, wherein the controller generates a black display signal for the pixel when levels of all of the first photodetection signal, the second photodetection signal, and the third photodetection signal of the pixel are minimum levels, and the display element displays black based on the photodetection signal.

* * * * *